US006877844B2

(12) United States Patent
Usui

(10) Patent No.: US 6,877,844 B2
(45) Date of Patent: Apr. 12, 2005

(54) FILM-FORMING DEVICE, LIQUID MATERIAL FILLING METHOD THEREOF, DEVICE MANUFACTURING METHOD, DEVICE MANUFACTURING APPARATUS, AND DEVICE

(75) Inventor: Takahiro Usui, Shiojiri (JP)

(73) Assignee: Seiko Epson Corporation (JP)

( * ) Notice: Subject to any disclaimer, the term of this patent is extended or adjusted under 35 U.S.C. 154(b) by 7 days.

(21) Appl. No.: 10/447,657

(22) Filed: May 29, 2003

(65) Prior Publication Data

US 2004/0032467 A1 Feb. 19, 2004

(30) Foreign Application Priority Data

May 30, 2002 (JP) ..... 2002-158022

(51) Int. Cl.[7] ..... B41J 2/045
(52) U.S. Cl. ..... 347/70
(58) Field of Search ..... 347/54, 61, 68, 347/70, 71, 72

(56) References Cited

U.S. PATENT DOCUMENTS 6,074,043 A * 6/2000 Ahn ..... 347/54
6,142,615 A * 11/2000 Qiu et al. ..... 347/70

FOREIGN PATENT DOCUMENTS

| | | | | |
|---|---|---|---|---|
| JP | 61-69467 | * | 4/1986 | ..... 347/54 |
| JP | 2-266945 | * | 10/1990 | ..... 347/54 |
| JP | 06-191049 | | 7/1994 | |
| JP | 11-058779 | | 3/1999 | |

* cited by examiner

*Primary Examiner*—Anh T. N. Vo
(74) *Attorney, Agent, or Firm*—Harness, Dickey & Pierce, P.L.C.

(57) ABSTRACT

A liquid material is filled into a head of a film-forming device. The head is used for discharging liquid drops. A vibration-applying means for applying vibrations to the liquid material filling the liquid material is included.

9 Claims, 7 Drawing Sheets

FILM-FORMING DEVICE, LIQUID MATERIAL FILLING METHOD THEREOF, DEVICE MANUFACTURING METHOD, DEVICE MANUFACTURING APPARATUS, AND DEVICE

BACKGROUND OF THE INVENTION

1. Technical Field of the Invention

The present invention relates to a film-forming device, a liquid material filling method thereof, a device manufacturing method, a device manufacturing apparatus, and a device.

2. Description of the Related Art

Electronic apparatuses, for example, computers or portable information device terminals have been developed, entailing an increase use of liquid crystal display devices, in particular, color liquid crystal display devices. These kinds of liquid crystal display devices utilize a color filter in order to colorize display images.

The color filter includes a filter having a substrate and being formed by supplying R (red), G (green) and B (blue) inks on the substrate in a predetermined pattern. As methods for supplying ink to such a substrate, for example, an ink jet type film-forming device has been employed.

In case of employing an ink jet type film-forming device, the film-forming device discharges a predetermined amount of ink from an ink jet head and supplies the ink to a substrate. In this case, as an ink discharge means, means in which a plurality of nozzle openings are formed on a wall constituting an ink tank together with discharging piezoelectric elements by conforming the piezoelectric elements to the direction of their expansion/contraction to each of the nozzle openings in order to face each of the nozzle openings, has been frequently used. As this type of piezoelectric elements, a piezoelectric element in which an electrode and a piezoelectric material are alternately stacked in a sandwich shape is provided, for example, in Japanese Unexamined Patent Application No. 63-295269. This piezoelectric element is configured such that the ink filled in a cavity (or an ink reservoir) of the ink jet head is discharged by the pressure wave caused by the deformation of the piezoelectric element.

Since there is a limitation to dischargeable ink viscosity in such an ink jet head, it is difficult to discharge a high viscosity ink. Therefore, conventionally, a technique in which an ink tank communicating with a pressure chamber via a supply opening is provided with a heater (or heat generating body) (Japanese Unexamined Patent Application Publication No. 5-281562) and a technique in which heaters are embedded in both an ink jet head and an ink tank (Japanese Unexamined Patent Application Publication No. 9-164702), are provided. By using these techniques, a high viscosity ink is changed to an ink with a dischargeable viscosity, i.e. low viscosity, thereby enabling industrial chemicals to be used, which were conventionally difficult to form into a film.

However, the following problems occur in the prior art as described above.

The above-mentioned method, which makes the viscosity low by heating, cannot be employed for ink having properties which change when heated, and cannot improve a situation in which discharging is difficult.

Further, when filling ink into an ink jet head, for example, an ink tank outside the head is connected to the head and a nozzle part of the head is evacuated by negative pressure.

However, since ink flow passages within the head are fine, bubbles may gather in portions where the flow of ink stagnates, such as in bent portions, in portions whose flow passage width varies, or in uneven portions, thereby disabling the discharge of ink. When bubbles remain within the head as above, since the pressure loss at discharging ink becomes great, a problem occurs in which not only the discharge of ink becomes unstable, but also ink cannot be evenly discharged.

The present invention has been made in consideration of the above problems. It is therefore an object of the present invention to provide a film-forming device, a liquid material filling method thereof, a device manufacturing method, a device manufacturing apparatus, and a device, which enable filling of ink into the head without heating the ink or leaving bubbles within flow passages even for a high-viscosity ink.

SUMMARY

The present invention provides a liquid material filling method of a film-forming device for filling a liquid material into a head of the film-forming device, the head discharging liquid drops, comprising: a vibration-applying step of applying vibrations to the liquid material while filling the liquid material.

Therefore, according to the present invention, since bubbles move easily along with the liquid material during filling, it is possible to prevent a problem in which bubbles gather in portions where the liquid material stagnates. For this reason, it is possible to fill the liquid material into the head without leaving bubbles within the flow passage, and it is possible to avoid a situation in which the discharge of liquid drops becomes unstable or falls into an non-dischargeable state.

Further, according to the present invention, the liquid material can be applied even to a non-Newtonian pseudoplastic fluid. The shear rate of the non-Newtonian pseudoplastic fluid becomes high by the application of vibration, and as a result, its viscosity becomes low. For this reason, even in case of a high viscosity of liquid material, the viscosity thereof during filling can be made low without heating the liquid material to improve the fluidity. Since this enables the bubbles within flow passages to be discharged without remaining therein, it is possible to avoid a situation in which the discharge of liquid drops becomes unstable or falls into an non-dischargeable state.

In case that a discharge step of discharging the liquid drops by applying vibrations to the head by driving the piezoelectric elements is included, it is preferable that in the vibration-applying step, vibrations are applied to the liquid material by driving the piezoelectric elements.

In this regard, according to the present invention, this makes it unnecessary to provide a separate mechanism for applying vibrations to the liquid material during the filling thereof and it is possible to contribute to the miniaturization or the lowering of cost of the device. Moreover, in this case, it is preferable to apply vibration to the liquid material with a vibration characteristic that does not cause liquid drops to be discharged from the head, in the vibration-applying step.

Further, in case that a discharge step of discharging the liquid drops by generating bubbles in the liquid material is included, a step of applying vibrations to the liquid material by the expansion/contraction of the bubbles can be employed in the vibration-applying step. This also makes it unnecessary to provide a separate mechanism for applying vibrations to the liquid material during the filling thereof and makes it possible to contribute to the miniaturization or the lowering of cost of the device.

On the other hand, the present invention provides a device manufacturing method comprising a filling step of filling a liquid material into a head and a film-forming step of discharging liquid drops from the head to form a film on a substrate, wherein the filling step is performed using the afore-mentioned liquid material filling method of the film-forming device.

According to the present invention, the above method makes it possible to avoid a situation in which bubbles remain in the head during the filling of the liquid material, and the discharge of liquid drops becomes unstable or falls into a non-dischargeable state. Hence, a film can be formed on the substrate with desired characteristics.

Also, the present invention provides a film-forming device comprising a head for discharging liquid drops, wherein the device includes vibration-applying means for applying vibrations to the liquid material when the liquid material is filled into the head.

Therefore, according the present invention, since bubbles move easily along with the liquid material during the filling thereof, it is possible to prevent a problem in which bubbles gather in portions where the liquid material is stagnated, and the like. For this reason, it is possible to fill the liquid material into the head without leaving the bubbles within flow passages. Therefore, it is possible to avoid a situation wherein the discharge of liquid drops becomes unstable or falls into a non-dischargeable state.

Further, according to the film-forming device of the present invention, the liquid material can be applied even to a non-Newtonian pseudo-plastic fluid. The shear rate of the non-Newtonian pseudo-plastic fluid becomes high by the application of vibration, and as a result, the viscosity of the fluid becomes low. For this reason, even in case of a high viscosity liquid material, the viscosity of the material during the filling thereof can be made low without heating the liquid material to improve the fluidity. Since this enables the bubbles within flow passages to be discharged without remaining therein, it is possible to avoid a situation in which the discharge of liquid drops becomes unstable or falls into a non-dischargeable state.

It is preferable that the vibration-applying means is a piezoelectric element for applying vibrations to the head to discharge liquid drops. According to the present invention, it is unnecessary to provide a separate mechanism for applying vibrations to the liquid material during the filling thereof and it is possible to contribute to the miniaturization or the lowering of cost of the device. Moreover, in this case, it is preferable to apply vibration to the liquid material with a vibration characteristic that does not cause liquid drops to be discharged from the head.

Further, as the vibration-applying means, a constitution which comprises a bubble generator for generating bubbles in the liquid material to discharge the liquid drops, and a control device for controlling the driving of the bubble generator so as to expand/contract the generated bubbles can be employed.

In this regard, it is unnecessary to provide a separate mechanism for applying vibrations to the liquid material during the filling thereof and it is possible to contribute to the miniaturization or the lowering of cost of the device.

On the other hand, the present invention provides a device manufacturing apparatus comprising a film-forming device for forming films on a substrate with liquid drops discharged from a head, wherein the film-forming device described above is used as the film-forming device.

According to the present invention, it is possible to avoid a situation in which bubbles remain in the head during filling of the liquid material, and thereby the discharge of liquid drops becomes unstable or falls into a non-dischargeable state. As a result, films with desired characteristics can be formed on the substrate.

Also, the present invention provides a device manufactured by the device manufacturing apparatus described above. According to the present invention, it is possible to obtain a high quality device on which a film formed with liquid drops that have been stably discharged.

DETAILED DESCRIPTION

Now, an embodiment of a film-forming device, a liquid material filling method thereof, a device manufacturing method, a device manufacturing apparatus, and a device of the present invention will be explained with reference to FIG. 1 to FIG. 7.

In this embodiment, as the film-forming device of the present invention, a film-forming device that is applied to a filter manufacturing apparatus for manufacturing a color filter, or the like used for a liquid crystal device by using, for example, ink as a liquid material will be explained. Further, a liquid that can be used in the present invention is included in the liquid material. That is, in addition to the above-mentioned liquid, the liquid material means a liquid material containing, for example, fine particles such as metals.

Figure 1:
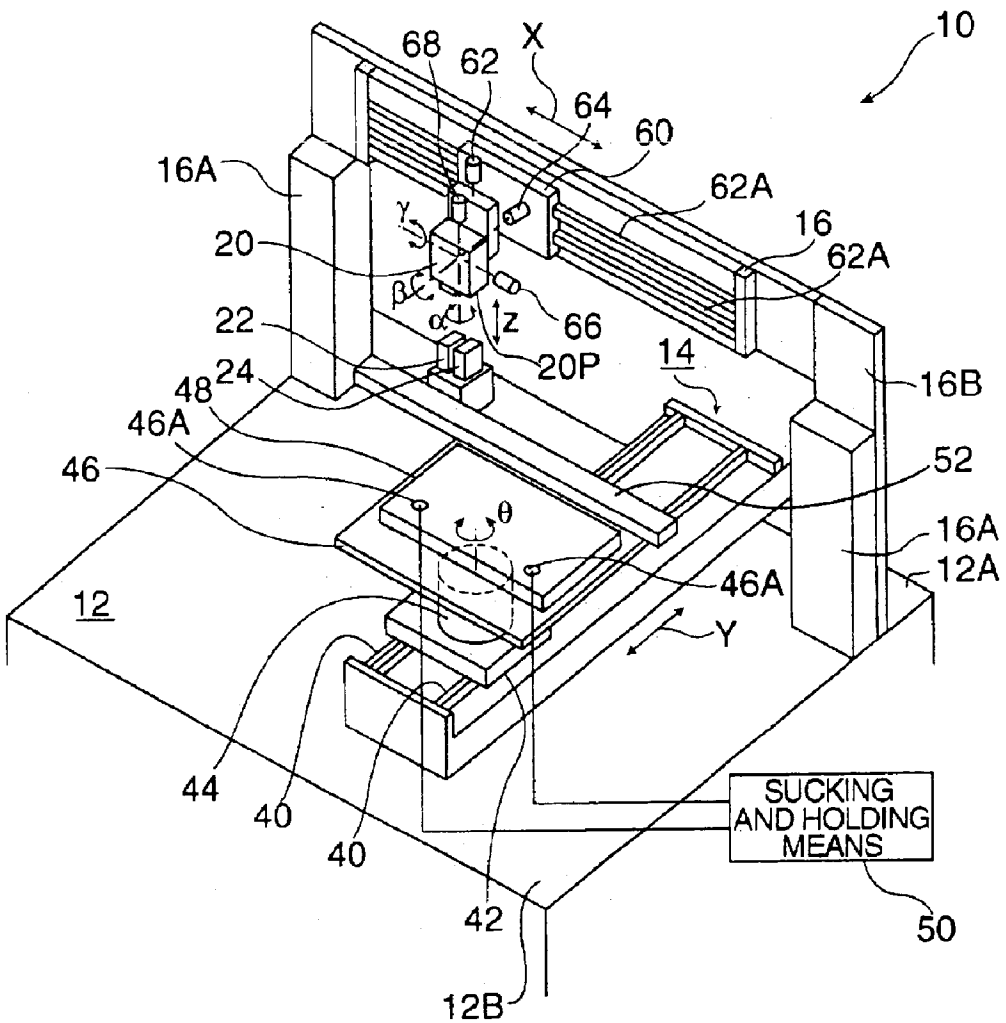
FIG. 1 is a schematic perspective view of the external appearance of a film-forming device constituting a filter manufacturing apparatus of the present invention.

FIG. 1 is a schematic perspective view of the external appearance of a film-forming device (ink jet device) 10 constituting a filter manufacturing apparatus. The filter manufacturing apparatus comprises three film-forming devices 10 having similar structures. Each of the film-forming devices 10 is configured to discharge the respective color inks of R (red), G (green) and B (blue) on a filter substrate, respectively.

The film-forming device 10 comprises a base 12, first moving means 14, second moving means 16, an electronic force balance (or weight measuring means), which is not shown, an ink jet head (or a head) 20 as a liquid drop discharge head, a capping unit 22, a cleaning unit 24, and others. The first moving means 14, the electronic force balance, the capping unit 22, the cleaning unit 24, and the second moving means 16 are installed on the base 12.

The first moving means 14 is preferably installed directly on the base 12, and the first moving means 14 is positioned along the direction of the Y-axis. In contrast, the second moving means 16 is attached upright relative to the base 12 using struts 16A and 16A, and the second moving means 16 is attached to a rear part 12A of the base 12. The direction of the X-axis of the second moving means 16 is a direction orthogonal to the direction of the Y-axis of the first moving means 14. The Y-axis is an axis along the direction of a front part 12B and the rear part 12A of the base 12. In contrast, the X-axis is an axis along the left-and-right parts of the base 12. The Y-axis and the X-axis are horizontal, respectively.

The first moving means 14 has guide rails 40. The first moving means 14 can employ, for example, a linear motor. A slider 42 of the first moving means 14 of this linear motor type can move and be positioned in the direction of the Y-axis along the guide rail 40.

The slider 42 includes a motor 44 for the θ axis. The motor 44 is, for example, a direct drive motor, and a rotor of the motor 44 is fixed to a table 46. According to this constitution, the supply of electric power to the motor 44 causes the rotor and the table 46 to rotate in the direction of θ, thereby enabling indexing (or rotational indexing) of the table 46.

The table 46 positions and holds the substrate 48. Further, the table 46 has vacuum and holding means 50. The operation of the vacuum and holding means 50 enables the substrate 48 to be suctioned through holes 46A of the table 46 and held on the table 46. Table 46 is provided with a preliminary discharge area 52 for the try-out or trial discharge (preliminary discharge) of ink from the ink jet head 20.

The second moving means 16 has a column 16B fixed to the struts 16A and 16A, and the column 16B has the linear motor type second moving means 16 thereon. A slider 60 can move and be positioned in the direction of the X-axis along the guide rails 62A, and the slider 60 thereon has the ink jet head 20 as a liquid drop discharge means.

The ink jet head 20 has motors 62, 64, 66 and 68 as rocking and positioning means. The operation of the motor 62 enables the ink jet head 20 to move and be positioned upwardly and downwardly along the Z-axis. The Z-axis is an axis along the direction (up-and-down direction) orthogonal to the X-axis and the Y-axis, respectively. The operation of the motor 64 enables the ink jet head 20 to rock and be positioned in the direction of β around the Y-axis. The operation of the motor 66 enables the ink jet head 20 to rock and be positioned in the direction of γ around the X-axis. The operation of the motor 68 enables the ink jet head 20 to rock and be positioned in the direction of α around the Z-axis.

As such, the ink jet head 20 in FIG. 1 can move linearly in the direction of Z-axis on the slider 60 and can rock and be positioned along the direction of α, β or γ, and an ink discharge surface 20P of the ink jet head 20 can be exactly positioned or controlled in its posture relative to the substrate 48 on the table 46. Further, the ink discharge surface 20P of the ink jet head 20 is provided with a plurality of (for example, 120) nozzles as openings, each of which discharges ink.

Figure 2:
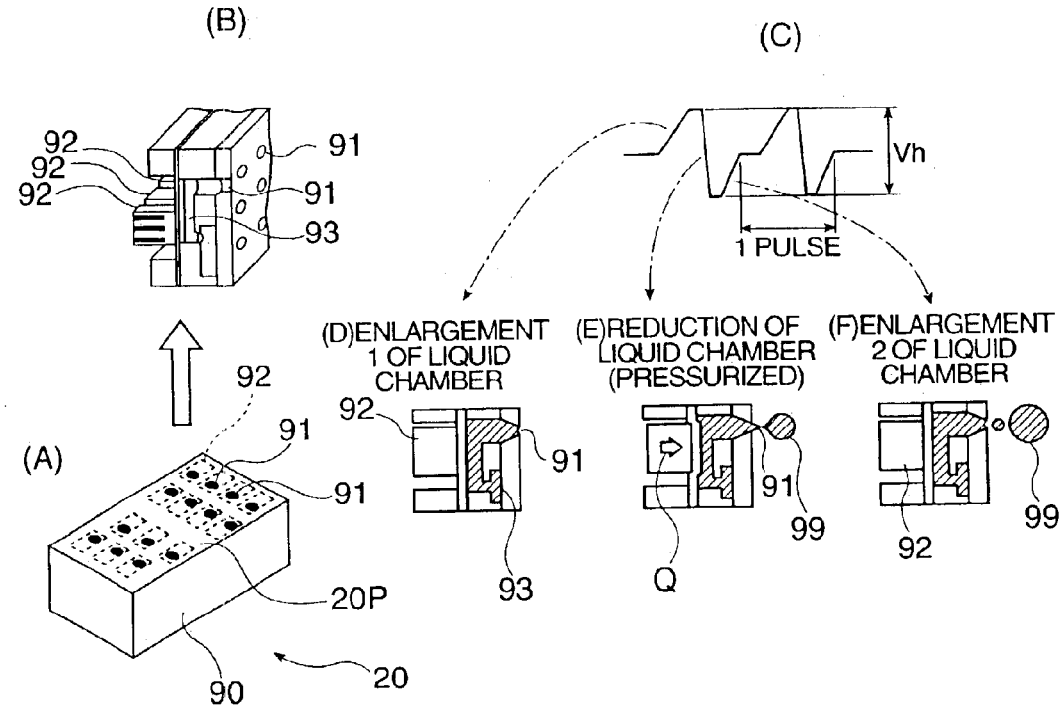
FIGS. 2(A)–2(F) show a structure of an ink jet head wherein (A) is a perspective view of the outer appearance of a main body of the head, (B) is a partially enlarged view thereof, (C) is a view showing relationship between time and applying voltage, and (D) to (F) are operational views of a liquid chamber shown for respective applying voltages.

Now, an exemplary structure of the ink jet head 20 will be explained with reference to FIG. 2. The ink jet head 20 is a head that uses, for example, piezoelectric elements (sometimes referred to as piezo-elements). As shown in FIG. 2(A), the ink discharge surface 20P of a head main body 90 is provided with a plurality of nozzles 91. These nozzles 91 are provided with piezo-elements 92, respectively.

As shown in FIG. 2(B), the piezo-elements 92 are disposed corresponding to the nozzles 91 and ink chambers 93, and are configured to be located between, for example, a pair of electrodes (not shown) so as to be protruded and flexed outwardly when electric power is supplied thereto. Therefore, as shown in FIG. 2(C), an applying voltage Vh is applied to the piezo-elements 92, thereby to cause the piezo-elements 92 to expand or contract in the direction of the arrow Q as shown in FIGS. 2(D), 2(E) and 2(F). Hence, ink is pressurized to discharge a predetermined amount of a liquid drop (or an ink drop) 99 from the nozzles 91.

Figure 3:
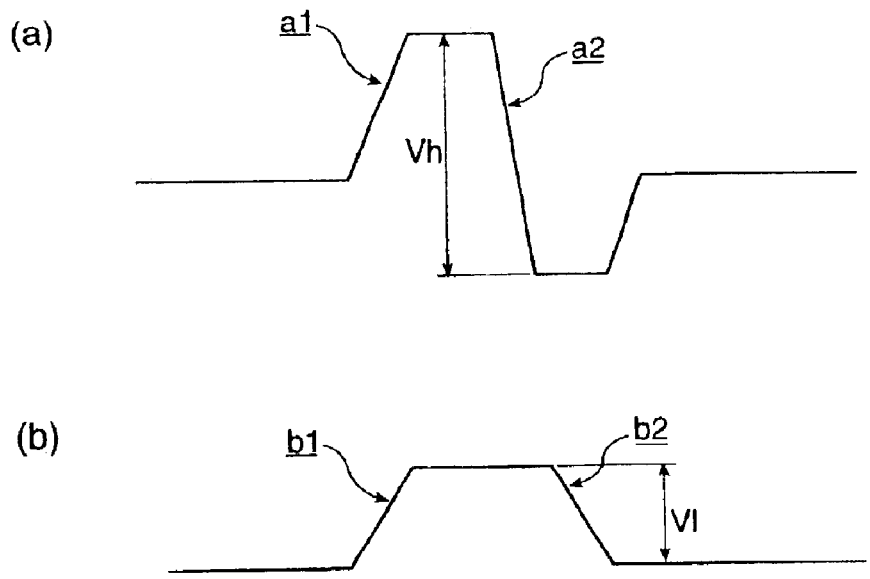
FIG. 3(*a*) shows a discharge waveform, and 3(*b*) shows a micro-vibration waveform.

More specifically, as shown in a discharge waveform view of FIG. 3(*a*), an ink chamber is enlarged at a positive gradient of a waveform portion a1 to increase its volume, and the ink equivalent to the increased volume flows into the ink chamber. Further, the ink chamber is reduced at a negative gradient of a waveform portion a2 by applying the applying voltage Vh, and ink is pressurized to discharge a predetermined amount of ink from the nozzle 91. Moreover, the ink jet type of the ink jet head 20 may include, for example, a thermal ink jet type using thermal expansion, in addition to the piezoelectric jet type which utilizes the aforementioned piezoelectric elements 92.

Figure 4:
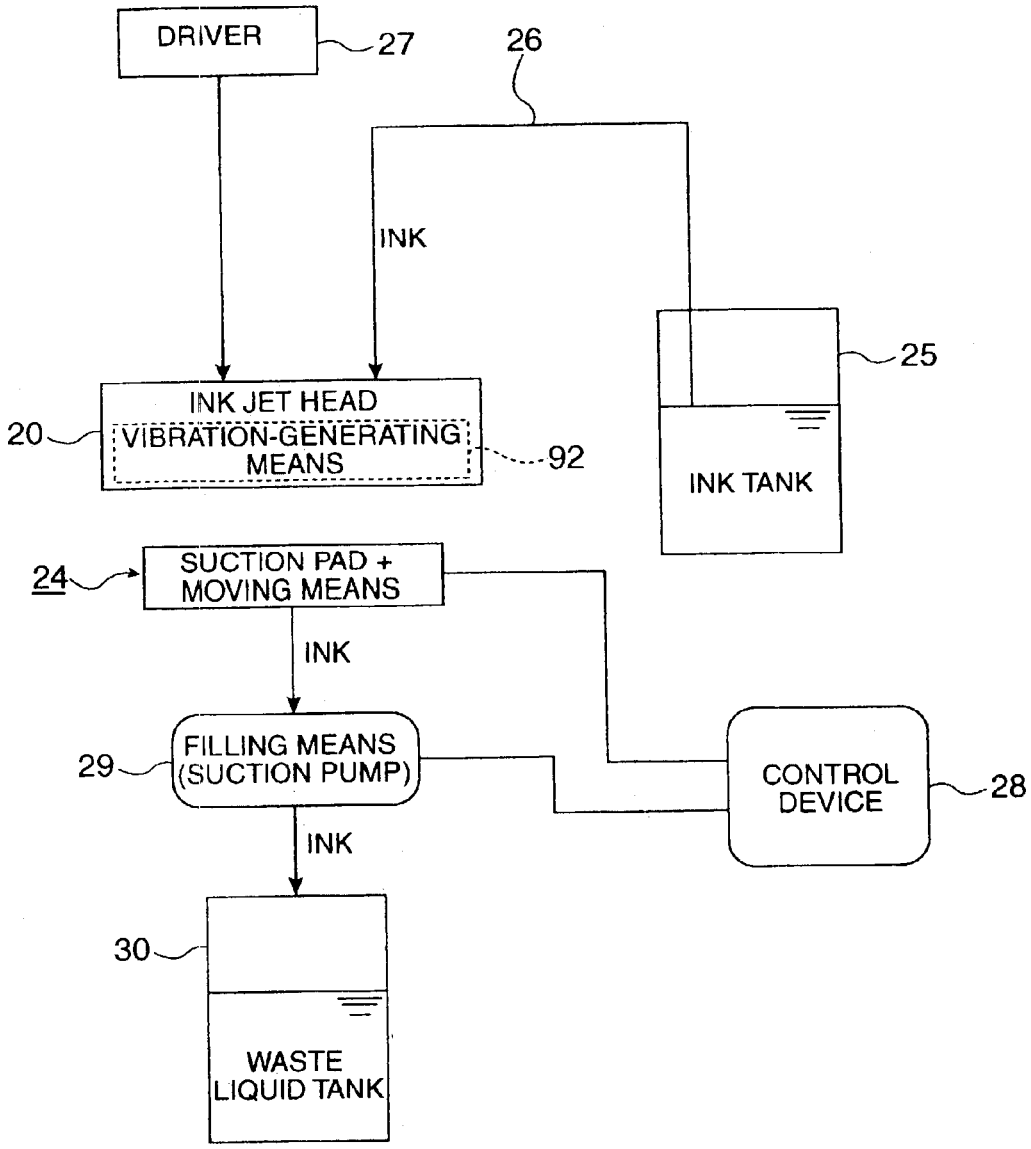
FIG. 4 shows a driving control system and an ink supply system relating to the ink jet head.

FIG. 4 shows a driving control system and an ink supply system relating to the ink jet head 20.

The ink reserved in an ink tank 25 is supplied via an ink path 26 to the ink jet head 20. Further, in order to discharge a predetermined amount of ink to the nozzles 91, driving voltage suitable for the kind or temperature of ink is applied to the piezo-elements 92 provided in the ink jet head 20, respectively, from an ink jet head driver 27 under the control of a control device 28. Further, the control device 28 controls the driver 27 to cause not only the discharge waveform as shown in FIG. 3(*a*), but also a micro-vibration waveform as shown in FIG. 3(*b*), as a driving wave to be applied to the piezo-elements 92.

The micro-vibration waveform is constituted such that an ink chamber is enlarged at a positive gradient of a waveform portion b1 and that the ink chamber is reduced and pressurized at a negative gradient of a waveform portion b2 by the application of applying voltage V1. However, the applying voltage V1 is set not to discharge ink from the nozzle 91. That is, the voltage with such micro-vibration waveform is applied to the piezo-elements 92, to micro-vibrate meniscuses so as to repeat the separation or the approach toward or away from the nozzle surface. In other words, in this embodiment, the piezo-elements 92 as pressure generating means are also used as vibration generating means (or vibration-applying means), and are driven by the amplitude (vibration characteristics) without discharging ink from the nozzles 91.

Regularly or frequently, the cleaning unit 24 can perform cleaning of the nozzles and the like of the ink jet head 20 during the filter manufacturing process or at a time stand-by time. The capping unit 22 is provided for the ink discharge surface 20P not to be exposed to ambient air at the stand-by time such that the ink within the nozzles of the ink jet head 20 does not dry. The cleaning unit 24 has moving means (see FIG. 4), which moves a suction pad between its abutted position and its separated position relative to the ink jet head 20 under the control of the control device 28. Suction means (filling means) 29 constituted by a suction pump, etc. is connected to the suction pad, and the ink, which has been suctioned via the suction pad, is discharged into a waste liquid tank.

Referring back to FIG. 1, the electronic force balance receives ink drops, for example, equivalent to 5000 drops from the nozzles of the ink jet head 20 in order to measure and manage the weight per drop of ink drops discharged from the nozzles of the ink jet head 20. The electronic force balance can divide the weight of the ink drops equivalent to 5000 drops by 5000, thereby to measure almost the exact weight per drop of ink drops. Based on the weight of such measured ink drop, the amount of ink drops to be discharged from the ink jet head 20 can be controlled.

Subsequently, the operation of filling ink into the ink jet head 20 will be explained.

First, at the beginning of a film-forming treatment process (liquid drop discharge process), liquid is not yet introduced into the ink jet head 20. Thus, before the film-forming treatment, the suction means 29 applies suction to the ink jet head 20 to introduce ink into the ink jet head 20. Specifically, the control device 28, first, causes the suction pad of the cleaning unit 24 to abut the ink jet head 20 using the moving means, and then causes the suction means 29 to operate. In this regard, the ink within the ink tank 25 is drawn and is filled into the ink jet head 20 via a liquid feeding tube 26. The ink filled into the ink jet head 20 is suctioned by the suction pad and is drained into a waste liquid tank 30 via the suction means 29.

Here, when filling ink into the ink jet head 20, the control device 28 controls the driver 27 to apply the driving voltage of the micro-vibration waveform, to the piezo-elements 92, as shown in FIG. 3(*b*). This enables vibration to be applied to the ink within the ink jet head 20 within the range not to discharge ink from the nozzles 91. Even when bubbles are present in the ink, the bubbles are attached to the wall of flow passages, or the bubbles are gathered in portions where ink is stagnated, this enables the bubbles to be drained along with the ink from the ink jet head 20 because the bubbles are vibrated along with the ink.

Figure 5:
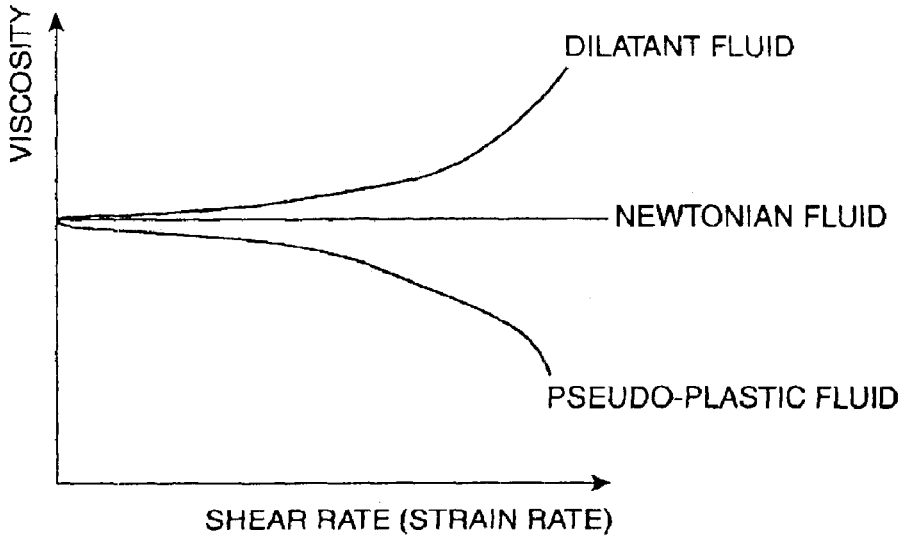
FIG. 5 shows the relationship between the shear rate and the viscosity of a fluid.

Generally, fluid is classified into a Newtonian fluid whose viscosity does not depend on its shear rate and into a non-Newtonian fluid whose viscosity varies depending on its shear rate. Further, the non-Newtonian fluid is classified into a dilatant fluid and into a pseudo-plastic fluid according to the trend of change in their viscosity. FIG. 5 shows the relationship between the shear rate (strain rate) and the viscosity of the respective fluids. As illustrated, the Newtonian fluid is almost constant in its viscosity, although its shear rate becomes high, whereas the dilatant fluid of the non-Newtonian fluid has a property whose viscosity becomes high as its shear rate becomes high. On the other hand, the pseudo-plastic fluid of the non-Newtonian fluid has a property whose viscosity becomes low as its shear rate becomes high.

For that reason, when the non-Newtonian pseudo-plastic fluid type ink is used, the shear rate of the ink becomes high, and thus its viscosity can be made low by applying vibrations during filling of the ink jet head 20. Therefore, in addition to the easy movement of bubbles by vibration as described above, the viscosity of the ink can be made low to improve the fluidity of the ink, and bubbles can be drained easily without remaining within the head 20.

Subsequently, driving the ink jet head 20 will be explained.

As described above, when ink controlled at a temperature of, for example, 40° C., is filled into the ink jet head 20 via the liquid feeding tube 26 from the ink tank 25, the driving voltage with the discharge waveform as shown in FIG. 3(*a*) is applied from the ink jet head driver 27, and piezo-elements 92 corresponding to the predetermined nozzles 91 are driven at a predetermined interval and period, thereby discharging ink from the predetermined nozzles 91.

Subsequently, a film-forming treatment process will be explained.

When an operator supplies the substrate 48 as a material onto the table 46 of the first moving means 14 from the front-end side of the table 46, the substrate 48 is suctioned and held against the table 46 and positioned thereto. Then, the motor 44 operates to set up the end faces of the substrate 48 parallel to the direction of the Y-axis.

Next, the ink jet head 20 moves along the direction of the X-axis and is positioned above the electronic force balance. Then, a designated number of drops (a designated number of ink drops) is discharged.

This causes the electronic force balance to measure, for example, the weight of 5000 ink drops so as to calculate the weight per drop of the ink drops. Then, it is determined whether the weight per drop of the ink drops falls within an appropriate predetermined range. If the weight falls outside the appropriate range, the adjustment of voltage to be applied to the piezoelectric elements 30, and the like is performed to appropriately obtain the weight per drop of the ink drops.

In case that the weight per drop of the ink drops is appropriate, the substrate 48 moves properly and is positioned in the direction of the Y-axis by the first moving means 14, and the ink jet head 20 moves properly and is positioned in the direction of the X-axis by the second moving means 16. Then, the ink jet head 20 preliminarily discharges ink to a preliminary discharge area 52 from all the nozzles, thereafter the ink jet head 20 moves in the direction of the Y-axis relative to the substrate 48 (actually, the substrate 48 moves in the direction of the Y-axis relative to the ink jet head 20), to discharge ink with a predetermined width from predetermined nozzles to a predetermined area on the substrate 48. When the relative movement between the ink jet head 20 and the substrate 48 is completed once, the ink jet head 20 moves in the direction of the X-axis by predetermined steps and thereafter ink is discharged while the substrate 48 moves relative to the ink jet head 20. Then, by repeating this operation a plurality of times, ink can be discharged to a whole film-forming area so as to form a film.

Subsequently, an example of manufacturing a color filter by the film-forming treatment will be explained with reference to FIG. 6 and FIG. 7.

Figure 6:
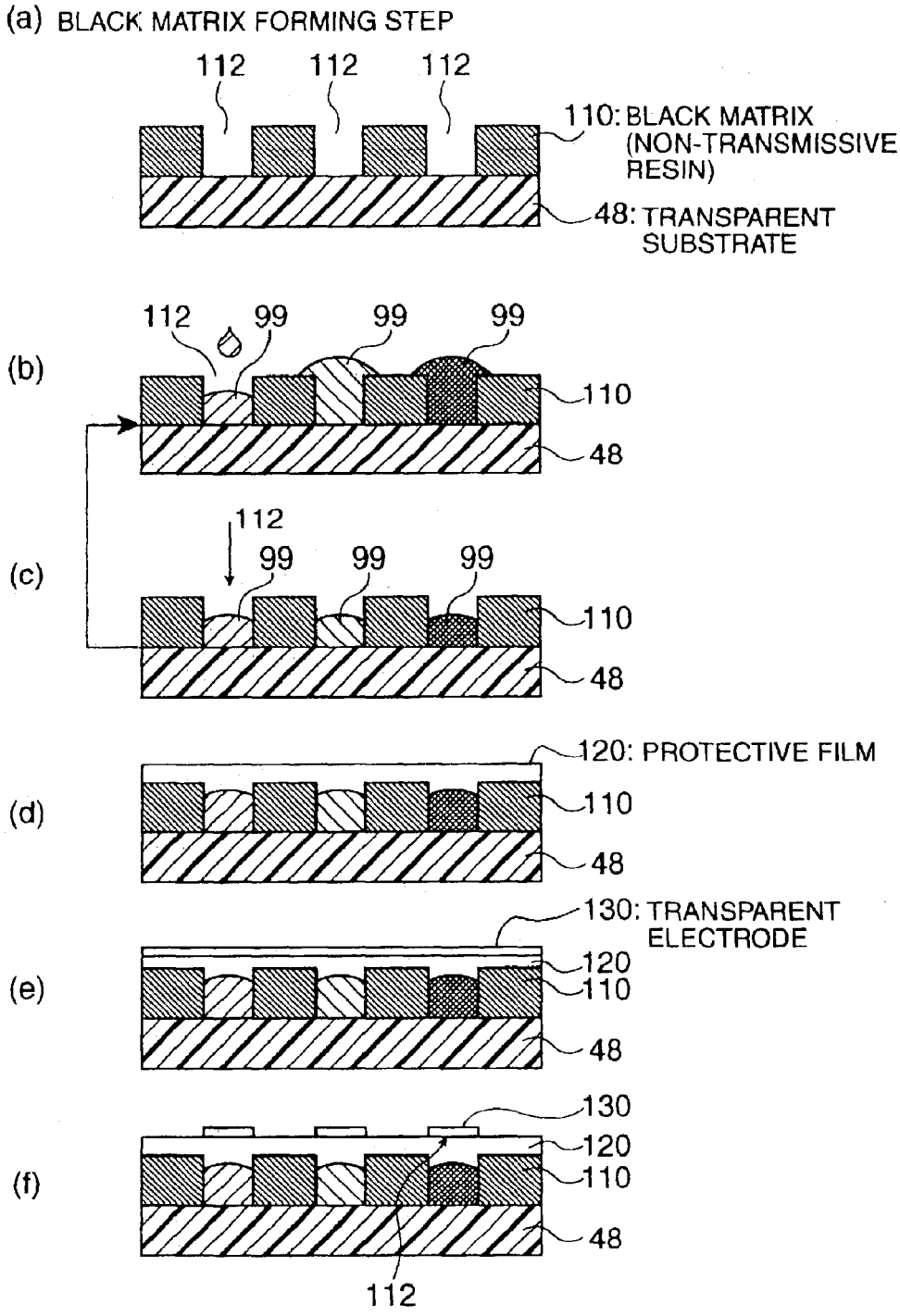
FIGS. 6(*a*) to 6(*f*) show an example of the procedure of manufacturing a color filter using a substrate.

As the substrate 48 in FIG. 6, a transparent substrate having appropriate mechanical strength and high light transmissivity is used. The substrate 48 may be applied to, for example, transparent glass substrates, acryl glass, plastics substrates, plastics films, surface-treated products thereof and the like.

Figure 7:
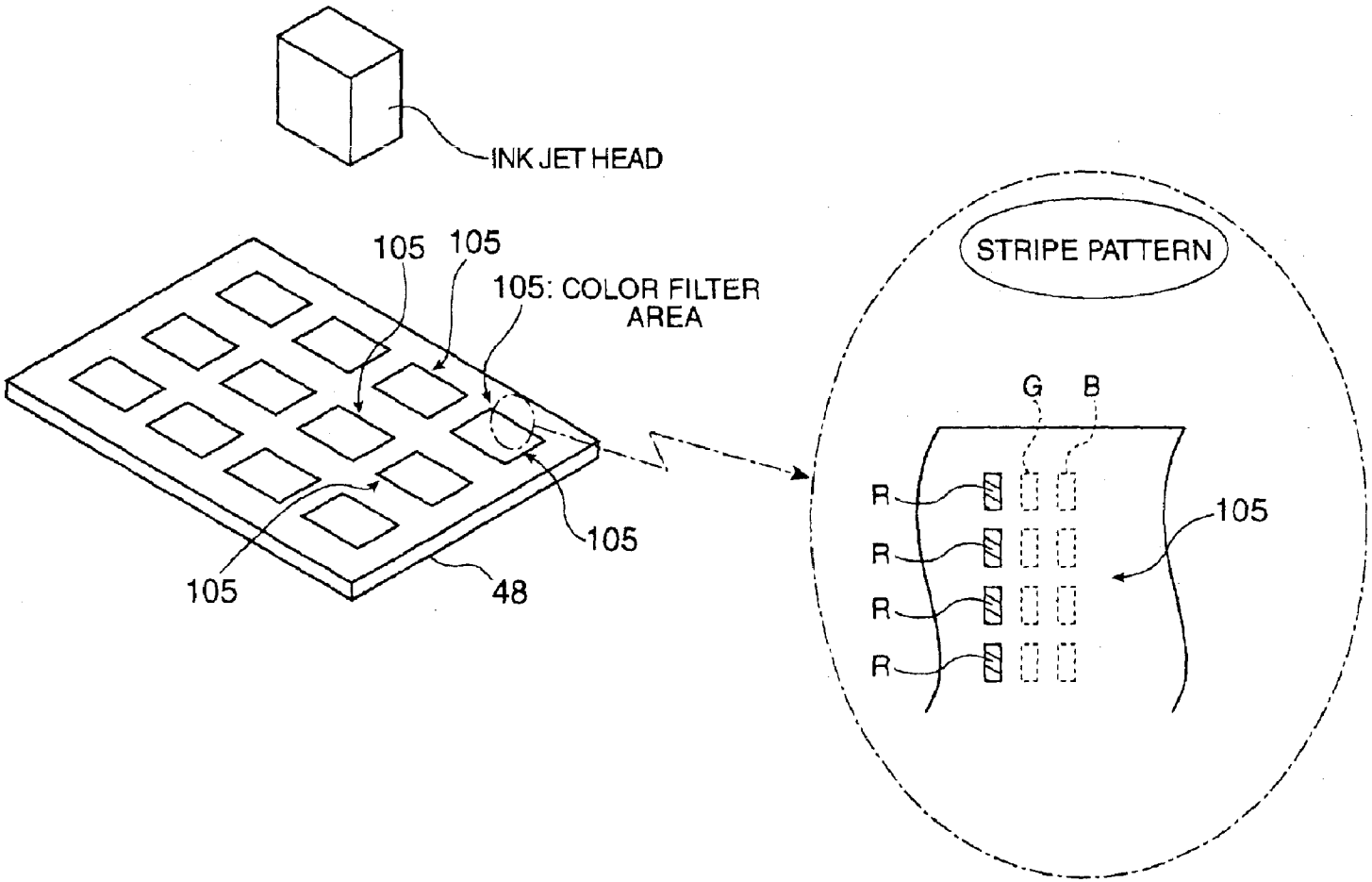
FIG. 7 shows a part of a substrate and color filter areas on the substrate.

For example, as shown in FIG. 7, a plurality of color filter areas 105 are formed in a matrix on a rectangular substrate 48 from the viewpoint of enhancing productivity. These color filter areas 105, after the substrate 48 has been cut, can be used as a color filter suitable for the liquid crystal display device.

As shown in FIG. 7, for example, R ink, G ink, and B ink are formed in a predetermined pattern and arranged in the color filter area 105. The pattern formed as such includes a mosaic pattern, a delta pattern, a square pattern, and the like in addition to the conventionally known stripe pattern as shown in the FIG. 7. In particular, when the head 20 inclines so that the pitch of nozzles corresponds to the arrangement pitch of pixel portions, the stripe pattern is effective because the number of nozzles capable of discharging at one time is large.

FIG. 6 shows an example of the procedure of manufacturing the color filter areas 105 on the substrate 48.

In FIG. 6(*a*), a black matrix 110 is formed on one surface of the transparent substrate 48. Resin (preferably, black resin) having no light transmissivity is applied with a predetermined thickness (for example, about 2 μm) on the substrate 48 as a foundation for a color filter by a spin coating method, or the like so as to prepare a black matrix 110 in a matrix by photolithography, or the like. The smallest display element surrounded by a lattice of the black matrix 110 is used as a filter element, which is, for example, a window having a width of about 30 μm in the direction of the X-axis, and a length of 100 μm in the direction of the Y-axis.

After the black matrix 110 has been formed, for example, as the heater applies heat, the resin is baked on the substrate 48.

As shown in FIG. 6(*b*), ink drops 99 are supplied to the filter elements 112. The amount of ink drops 99 is an adequate amount that is determined in consideration of the reduction of volume in ink during a heating process.

In FIG. 6(*c*), when the ink drops 99 are filled into all the filter elements 112 on the color filter, a heating treatment is performed using a heater.

The substrate 48 is heated to a predetermined temperature (for example, about 70° C.). When a solvent in ink evaporates, the volume of ink is reduced. In case that the reduction in, volume is severe, the ink discharging process and the heating process are repeated until a satisfactory thickness of ink film for a color filter is obtained. According to such treatment, the solvent in the ink evaporates finally leaving only a solid layer of ink, thereby forming a film.

In a protective film-forming process in FIG. 6(*d*), the ink drops 99 are heated at a predetermined temperature for a predetermined time so as to completely dry the ink drops. When the drying is completed, a protective film 120 is formed so as to protect the substrate 48 of the color filter on which an ink film is formed and to level the surface of the filter. For the formation of the protective film 120, for example, a spin coating method, a roll coating method, a ripping method, or the like can be employed.

In a transparent electrode forming process in FIG. 6(*e*), a transparent electrode 130 is formed over the whole surface of the protective film 120 using a sputtering method, a vacuum vapor deposition method, or the like.

In a pattering process in FIG. 6(*f*), the transparent electrode 130 is further subject to a pattering treatment so as to form pixel electrodes corresponding to the openings of filter elements 112.

Moreover, when TFTs (Thin Film Transistor) are used for the driving of liquid crystal, such patterning is not necessary. Further, it is preferable to wipe the ink discharge surface 20P of the ink jet head 20 regularly or frequently using the cleaning unit 24 during the film-forming process.

As describe above, this embodiment provides a process of applying vibrations to ink during ink filling, such that bubbles can move even in case of high-viscosity ink to fill ink without leaving the bubbles within the head. In particular, in case of ink of the pseudo-plastic fluid, not only bubbles can move but also the viscosity of ink is made, low without heating the ink, hence bubbles can be easily discharged from the head. In this regard, even in case of high-viscosity ink or non-heatable ink, it is possible to stably discharge ink from the head, and thus a film can be formed on a substrate with desired discharge characteristics. As a result, the ink discharged from the ink jet head 20 forms a film with desired shape and size, thereby enabling the quality of devices manufactured with the ink to be maintained.

Further, in this embodiment, since the piezo-elements 92 driven when discharging ink from the ink jet head 20 also serve as a vibration-applying means during ink filling, it is unnecessary to provide separate vibration-applying means and the contribution to the miniaturization or the lowering of cost of the device can be made.

Moreover, the present invention is not limited to the above embodiment, but various modifications can be made without departing from the scope of the claims.

For example, although the above embodiment is configured to discharge ink from the head by driving the piezo-elements, a constitution in which a heater serving as a bubble generator is disposed in the head, ink is discharged with bubbles generated by heating with a heater under the control of the control device is also applicable. In this case, during ink filling, it is possible to continuously perform driving/stopping of the heater within the range of not discharging ink, and it is possible to expand or contract bubbles to apply vibration to ink. Hence, the operations and the effects similar to those in case of employing the piezo-elements can be obtained.

Further, although the above embodiment relates to a constitution in which the film-forming device is applied to the filter manufacturing apparatus. The present invention is not limited to such constitution, but is also applicable to, for example, printers (or plotters) which type characters or form films on papers.

Moreover, the device manufacturing apparatus of the present invention is not limited to the manufacture of, for example, a color filter for a liquid crystal display device, but is applicable to the manufacture of an electroluminescence (EL) display device. The EL display device is an element having a configuration of sandwiching a thin film including an inorganic or organic fluorescent compound between a cathode and an anode, such element inject electrons and holes for recombination and generate excitons, thereby causing light to be emitted using the emission of light (florescence/phosphorescence) when the excitons are deactivated. Among fluorescent materials used for such EL display element, materials emitting respective luminescent colors of red, green and blue colors, i.e., a material for forming a light emitting layer and a material for forming a hole injection/electron carrier layer, are used as ink. The respective materials are patterned on an element substrate such as TFTs or TFDs, using the device manufacturing apparatus of the present invention, so that a self-luminescent full color EL device can be manufactured. In the scope of devices according to the present invention, such an EL device is included.

In this regard, in order to easily form partition walls for partitioning a resin resist per one pixel similar to the black matrix of the color filter, to adhere the discharged liquid drops on the surface of a layer as an underlayer, and to prevent the discharged liquid drops from being bounced off from a partition wall and from being mixed with the liquid drops within an adjacent region, a surface treatment as a pretreatment of the discharge of liquid drops, such as a plasma treatment, an ultraviolet treatment or a coupling treatment, is performed to the substrate. Thereafter, the device is manufactured via the first film-forming process of supplying a material for forming a hole injection/electron carrier layer as liquid drops to form a film, and similarly via the second film-forming process of forming a light emitting layer.

Such manufactured EL device can be applied to a segment display or a still image display which simultaneously emits light on its whole surface, for example, to the field of raw information such as pictures, characters or labels, and can be used as a light source having points, lines and surface shapes. Moreover, active elements such as TFTs including passive elements for passive-driving are used for driving, so that a full color display device with excellent responsiveness and high luminance can be obtained.

Further, when the film-forming device of the present invention is provided with a metal material or an insulating material, direct micro-patterning such as metal wiring, insulating film, or the like is possible, and the film-forming device can also be applied in the manufacturing of highly functional new devices.

Moreover, although the device has been named as "ink jet device" and "ink jet head" for the sake of convenience and the discharge material has been explained as ink in the above embodiment, the discharge material discharged from the ink jet head is not limited to, so called, ink, but may include any other material provided that the material is adjusted to be capable of being discharged as liquid drops from the head. For example, it is needless to say that the discharge material includes various materials such as the aforementioned EL device material, a metal material, an insulating material, or a semiconductor material.

Further, although the ink jet head 20 of the film-forming device as illustrated is configured to be capable of discharging one type of ink among R (red), G (Green) and B (blue) inks, it is naturally possible for the ink jet head 20 to simultaneously discharge two or three types of inks among the above three inks. Moreover, the fist moving means 14 and the second moving means 16 of the film-forming device 10 uses a linear motor. However, the present invention is not limited to such a motor and other types of motors or actuators can be used.

As explained above, according to the present invention, even in case of a high viscosity of liquid material, it is possible to fill the material into the head without heating the material or leaving bubbles in flow passages thereby to stably discharge liquid drops, it is possible to form a film with desired discharge characteristics, and it is possible to contribute to the miniaturization or the lowering of cost of the device. Further, according to the present invention, quality defects due to the instability of discharge do not occur and a high quality device can be obtained.

The entire disclosure of Japanese Patent Application No. 2002-158022 filed May 30, 2002 is incorporated by reference.

What is claimed is:

1. A liquid material filling method of a film-forming device comprising:

providing the film-forming device with a liquid material jet head;

providing a filling means for filling the head with a liquid material;

providing a vibrating means for selectively applying vibrations the liquid material in the head; and filling the head with the liquid material with the filling means while simultaneously applying vibrations to the liquid material with the vibrating means, the vibrations being controlled to retain the liquid material within the head and Prevent discharge of the liquid material during the filling step.

2. The liquid material filling method of a film-forming device according to claim 1, wherein the liquid material further comprises a non-Newtonian pseudo-plastic fluid.

3. The liquid material filling method of a film-forming device according to claim 1, wherein:

the vibrating means further comprises piezoelectric elements adapted to selectively vibrate the liquid material in the head; and the vibrations are applied to the liquid material by driving the piezoelectric elements in the filling step.

4. The liquid material filling method of a film-forming device according to claim 1, wherein the vibrating means generates bubbles in the liquid material, and the vibrating means applies the vibrations to the liquid material by at least one of expansion and contraction of the bubbles.

5. A film-forming device comprising:

a liquid material jet head for selectively discharging liquid material;

filling means for filling the head with the liquid material; and vibrating means for vibrating the liquid material in the head;

wherein the vibrating means is operable in a filling mode wherein vibrations are applied to the liquid material in the head simultaneously as the head is being filled with the liquid material by the filling means without discharging the liquid material from the head, and in a discharging mode wherein the liquid material is discharged from the head.

6. The film-forming device according to claim 5, wherein the liquid material further comprises a non-Newtonian pseudo-plastic fluid.

7. The film-forming device according to claim 5, wherein the vibrating means further comprises piezoelectric elements operable at a first driving voltage in the tilling mode and at a second driving voltage in the discharging mode.

8. The film-forming device according to claim 7, wherein the device further comprises a control device for controlling the driving voltage applied to the piezoelectric elements.

9. The film-forming device according to claim 5, wherein the vibrating means includes a bubble generator for generating bubbles in the liquid material; and further comprising a control device for controlling the driving of the bubble generator so as to cause at least one of expanding and contracting of the generated bubbles.

* * * * *